United States Patent [19]

Ryan

[11] Patent Number: 4,574,695

[45] Date of Patent: Mar. 11, 1986

[54] PRESS DAMPENING ROLL FOUNTAIN

[75] Inventor: Garth S. Ryan, Longueuil, Canada

[73] Assignee: Mirachem Corporation Ltee/Ltd., Quebec, Canada

[21] Appl. No.: 653,581

[22] Filed: Sep. 24, 1984

[51] Int. Cl.[4] ..... B41F 7/32

[52] U.S. Cl. ..... 101/148; 101/364

[58] Field of Search ..... 101/148, 364, 363, 366, 101/350, 207, 208, 210; 118/259

[56] References Cited

U.S. PATENT DOCUMENTS

| | | | |
|---|---|---|---|
| 2,018,193 | 10/1935 | Smith | 101/366 |
| 2,018,959 | 10/1935 | Jordhoy | 101/363 |
| 2,338,561 | 1/1944 | Zuckerman | 101/364 X |
| 3,045,592 | 7/1962 | Shearer et al. | 101/364 X |
| 3,326,123 | 6/1967 | Smalley | 101/366 X |
| 3,339,485 | 9/1967 | Rytterholm | 101/363 |
| 3,352,317 | 11/1967 | Dahlgren | 101/350 X |
| 3,439,609 | 4/1969 | Dorr | 101/366 |
| 3,587,463 | 6/1971 | Granger | 101/366 |
| 3,815,499 | 6/1974 | Abler | 101/366 X |
| 4,300,450 | 11/1981 | Gasparrini | 101/366 |

*Primary Examiner*—J. Reed Fisher

*Attorney, Agent, or Firm*—Charles Brown; Charles A. Brown

[57] ABSTRACT

In an elongated fountain pan, for an elongated press dampening roll, having a liquid inlet, the improvement comprising, providing the liquid inlet in the form of an elongated liquid inlet means extending lengthwise of the pan and accordingly lengthwise of the roll, the inlet means having a plurality of liquid outlet apertures therein and spaced therealong and the inlet means having liquid supply line means connected thereto and in such manner liquid exiting from the supply line means into the inlet means subsequently exits via apertures adjacent the ends of the inlet means generally simultaneously whereby to maintain, during operation of the press, a uniform temperature of the liquid in the pan as measured along the length of the roll. Also disclosed, is a method of maintaining a uniform temperature throughout the liquid in the fountain pan of a printing press and a method of cleaning a fountain solution of a printing press.

7 Claims, 6 Drawing Figures

Fig. 1
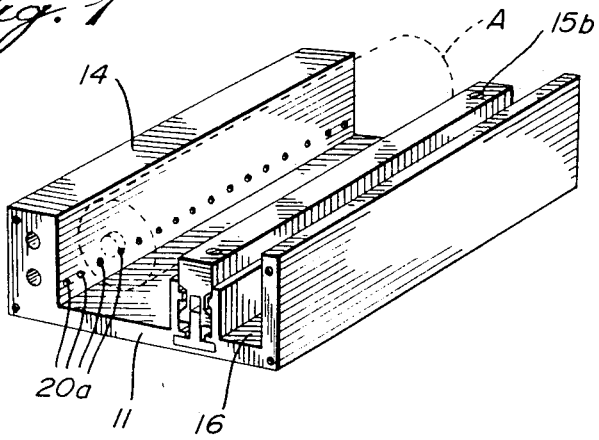
Fig. 2
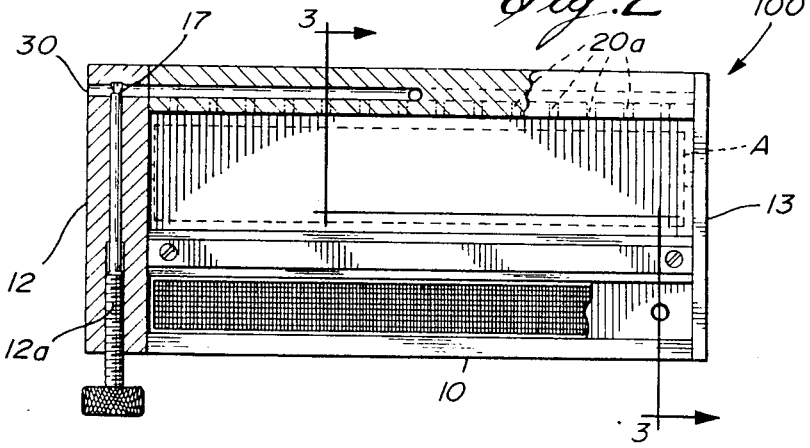
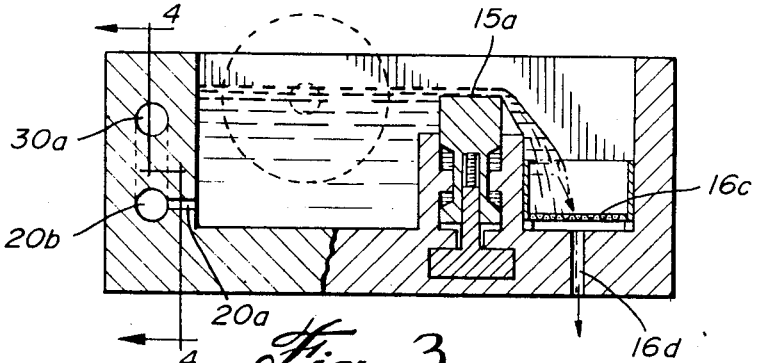
Fig. 3

PRESS DAMPENING ROLL FOUNTAIN

BACKGROUND OF THE INVENTION (a) Field of the Invention

The present invention relates to improvements in fountain designs, more particularly fountain pan designs of the type used for dampening rolls, and possibly other type rolls, of printing presses. It also relates to a method of maintaining a uniform temperature of the liquid in such fountains as measured along the length of the dampening roll, during operation of the press. It still further relates to a method of cleaning a fountain solution of a printing press.

(b) Description of Prior Art

The prior art fountain designs used for dampening rolls commonly comprise an elongated fountain pan wherein liquid, usually refrigerated dampening solution, sometimes containing alcohol, is introduced into one end thereof and is discharged adjacent the opposite end thereof. During operation of the press, the dampening rolls become heated, which in turn transfer heat to the pan liquid. Due to the position of the liquid inlet and outlet in the pan, the heated roll is subjected to non-uniform cooling along its length by the entering cooled liquid. As the cooled liquid moves along the pan toward the outlet it is heated, thus providing a differential in liquid temperature along the length of the pan and accordingly across the width of the dampening roll. As a result, the quality of printing by the press is affected.

Although some attempts have been made in the past to improve distribution of fluid entering the fountain pans, the aforementioned temperature differential problem remains.

Another drawback in respect of the prior art fountain designs is their lack of an efficient preliminary cleaning-filtering of the liquid being returned to the cleaning reservoir. The preliminary cleaning method of the prior art devices commonly comprises use of a single stand pipe (adjustable in height) in the pan. Such a device provides a limited overflow surface, accordingly a limited flow capacity, affecting volume of return flow to the reservoir. Furthermore, regarding the prior art devices, a relatively long path exists over which the liquid must travel from its point of entry into the pan to its point of departure from the pan, resulting in a number of disadvantages, including delay in dumping the heated liquid and delay in ridding the liquid of its foreign matter.

A further drawback in respect of the prior art designs is their lack of an efficient mechanism to permit proper throttling of the liquid entering the fountain pen. The integral throttling mechanism according to the present invention overcomes this drawback.

A further drawback in respect of the prior art devices is they do not permit continued running of the press while servicing the dampening roll fountain.

A further drawback in respect of the prior art devices is the need to insulate the fountain pan.

SUMMARY OF THE INVENTION

It is a prime object of the present invention to provide an improved fountain design more particularly an improved fountain pan for press dampening roll(s) which overcomes all of the aforementioned drawbacks and disadvantages.

In one aspect of the present invention there is provided in an elongated fountain pan, for an elongated press dampening roll, having a liquid inlet, the improvement comprising, providing the liquid inlet in the form of an elongated liquid inlet means extending lengthwise of the pan and accordingly lengthwise of the roll, the inlet means having a plurality of liquid outlet apertures therein and spaced therealong and the inlet means having liquid supply line means connected thereto and in such manner liquid exiting from the supply line means into the inlet means subsequently exits via apertures adjacent the ends of the inlet means generally simultaneously, whereby to maintain, during operation of the press, a uniform temperature of the liquid in the pan as measured along the length of the roll.

In a further aspect of the present invention, there is provided a method of maintaining, during operation of a printing press, a uniform temperature of the liquid in a pan for a dampening roll thereof, as measured along the length of the roll, comprising the steps of, providing a liquid dispensing means in the pan which means extends lengthwise of the pan and accordingly lengthwise of the roll in spaced relation thereto, the means comprising an elongated liquid carrying passage therein extending lengthwise of the roll and generally to the extent of the length of the roll, the passage having a plurality of liquid dispensing apertures spaced therealong, and providing a liquid supply line and connecting it to the liquid dispensing means, including routing the line such that it enters the passage generally centrally thereof.

In a still further aspect of the present invention there is provided a method of cleaning a fountain solution of a printing press, comprising the steps of, providing in the fountain, an elongated liquid overflow means such that it extends lengthwise of the roll serviced by the fountain and in spaced relation to the roll, and introducing liquid to the fountain whereby the fountain liquid to be cleaned overflows the over flow means, carrying with it foreign matter to be removed from the fountain solution.

BRIEF DESCRIPTION OF THE DRAWINGS

The invention is illustrated by way of example in the accompanying drawings wherein:

FIG. 1 is a perspective view of part of a press fountain in accordance with the present invention;

FIG. 2 is a part sectioned plan view of the fountain shown in FIG. 1;

FIG. 3 is a sectioned end view of the fountain shown in FIG. 1 taken along line 3—3 in FIG. 2;

DESCRIPTION OF PREFERRED EMBODIMENTS

Figure 4:
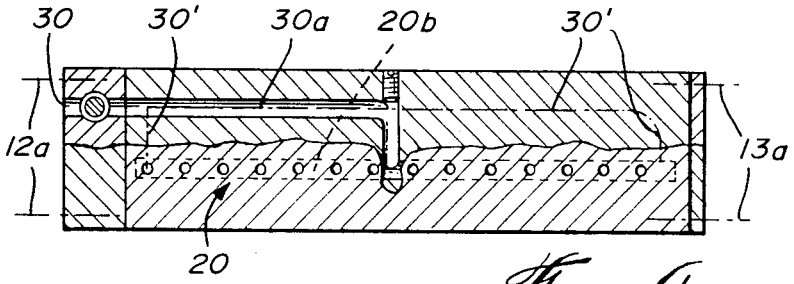
FIG. 4 is a sectioned elevational view of the fountain taken along 4—4 in FIG. 3.

Referring now in detail to the drawings. FIG. 2 basically illustrates a fountain arrangement 100 in accordance with the present invention. Arrangement 100 includes a fountain pan 10, an elongated liquid inlet means 20, best seen in FIGS. 1 and 4, and a liquid supply line means 30, best seen in FIGS. 2 and 4.

Fountain pan 10 comprises a main body 11 constructed from an extruded section material conveniently cut to desired length to accept therein roll A, in the present instance, a dampening roll of a printing press shown in phantom line. Body 11, as best seen in FIG. 2, includes end plates 12 and 13 (omitted from FIG. 1 for reasons of clarity). Alternatively, body 11 may comprise an injected moulding.

Elongated body 11, which may comprise any suitable material, including chlorinated polyvinyl chloride (to limit sweating caused from chilled liquid introduced therein) has an elongated manifold means 14, a dam wall reception cavity 15 and filter reception cavity 16.

End plate 13, a blanking end plate, serves to close off the one end of body 11, such being secured thereto by screws 13*a*. Likewise end plate 12 closes off the other end of body 11, such being secured thereto by screws 12*a*. End plate 12 houses a manually operable throttling valve 17, for controlling flow in liquid supply line 30. If desired, valve 17 may be controlled by instrumentation, including being operated by float means regulating liquid level within body 11. (not shown)

From the foregoing, it will be seen that both the liquid supply line and the valving controlling the liquid flow within supply line 30, is conveniently located adjacent one end of fountain arrangement 100.

Attention is directed to FIG. 4 showing liquid inlet means 20 extending lengthwise of body 11 and accordingly lengthwise of roll A. As seen, liquid inlet means 20, located adjacent a marginal edge of body 11, comprises a plurality of liquid outlet apertures 20*a* spaced therealong. Apertures 20*a* extend to connect with elongated bore 20*b* extending from end to end of body 11. As further seen in FIG. 4, supply line means 30 within body 11, comprises an elongated bore 30*a* extending in spaced parallel relation to bore 20*b* to terminate generally centrally of the length of bore 20*b*. Thus, liquid supply line means 30 is connected to liquid inlet means 20 in such manner, liquid entering from supply line means 30 into liquid inlet means 20, subsequently exits via apertures 20*a* adjacent the respective ends of liquid inlet means 20, generally simultaneously, whereby to maintain, during operation of the press, a substantially even temperature of the liquid in the body 11 - pan 10, as measured along the length of roll A.

As an alternative arrangement, in order to achieve similar distribution of the liquid into body 11 - pan 10, supply line means 30 may be branched whereby to enter liquid inlet means 20 adjacent its respective ends, i.e. adjacent end apertures 20*a* rather than centrally as shown in FIG. 4, see phantom line 30'. Accordingly, in such instance, bore 20*b* is fed adjacent the ends thereof rather than at its central area.

Figure 5:
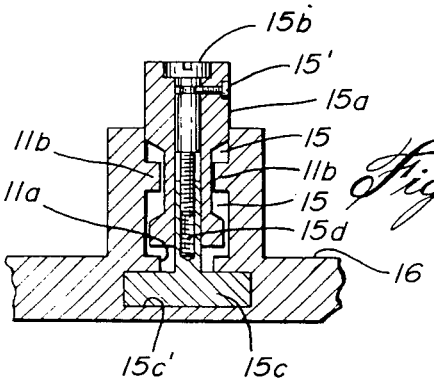
FIG. 5 is a fragmentary view of the fountain shown in FIG. 1, showing parts comprising liquid overflow means in accordance with the present invention.

Attention is directed to FIG. 5 showing the adjustable height elongated dam wall 15*a* (spill-way) provided by the present invention. Dam wall 15*a*, which may comprise for example nylon or teflon material, fits snugly within reception cavity 15 and is secured therein by a pair of bolts 15*b*, seen in FIGS. 1 and 5. Bolts 15*b*, which are held captive n wall 15*a* by screws 15', enter into an elongated foot portion 15*c* slidingly received within body 11 via channel 15*c'* comprising cavity 15 and prevented from moving in upward direction by shoulder 11*a*. Dam wall 15*a* is thus adjusted relative body 11 by the turning of bolts 15*b* upon screw threads 15*d*, accordingly "raising or lowering" the dam wall 15*a*. Upward and downward movement of dam wall 15*a* is controlled by shoulders 11*b*. As will be evident, assembly of dam wall 15*a* to body 11, is accomplished by relative sliding action, dam wall 15*a* being retained within body 11 by end plates 12 and 13 which snugly abut the same preventing liquid leaking therepast. Dam wall 15*a* and foot portion 15*c* may likewise be of extruded construction, thereafter conveniently drilled and tapped to receive bolts 15*b*.

An important aspect regarding dam wall 15*a* is that it extends in spaced relation to the elongated liquid inlet means 20 and in the case of one preferred embodiment disclosed, in spaced parallel relation thereto. Such provides an extensive length of spillway and provides a relatively short distance for the liquid to travel between inlet and outlet of the fountain pan.

Figure 6:
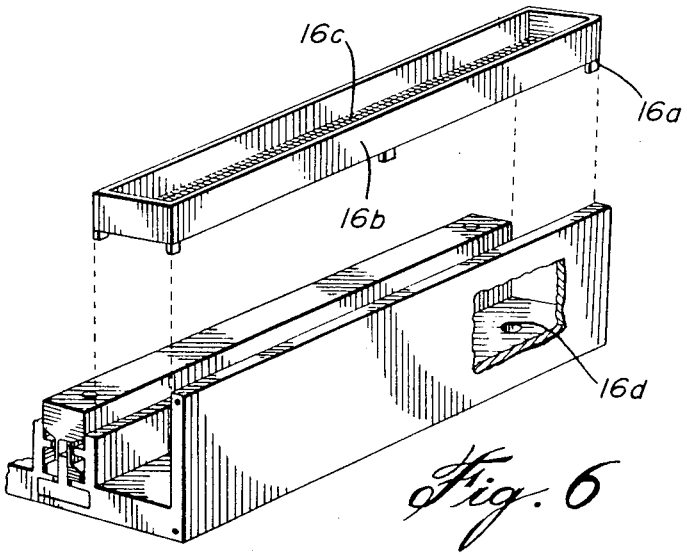
FIG. 6 is a fragmentary view of the fountain shown in FIG. 1, showing parts comprising a filter thereof.

Attention is directed to FIG. 6 showing filter 16*a* adapted to be snugly received within reception cavity 16, located adjacent dam wall 15*a*. Filter 16*a* comprises frame means 16*b* supporting mesh grid 16*c*. Located within reception cavity 16, is a drain outlet 16*d*. Thus, liquid passing over dam wall 15*a* is filtered by filter 16*a* prior to entering drain 16*d*, which in turn is usually connected to a further liquid cleaning reservoir (not shown).

Referring briefly to operation of arrangement 100. Valve means 17 is adjusted to allow liquid to enter within fountain body 11 - pan 10 via apertures 20*a*. The supplied liquid upon reaching a given level in the pan 10, determined by the adjusted height of dam wall 15*a*, will pass thereover, carrying with it foreign matter on its surface to be deposited upon filter 16*a*. The supplied liquid then passes to drain for cleaning and return to the fountain arrangement 100. The relatively short distance of travel of the liquid from entry to exit of the pan 10 helps to limit contamination of the liquid by foreign matter and also aids in keeping the liquid temperature down i.e. less time in the fountain where it is subjected to heat from roll A. This coupled with the aforedescribed improved distribution of the liquid entering the pan, assures cooler operation, and thus less rise in temperature of roll A, while maintaining uniform temperature therealong. Assembly and maintenance of fountain arrangement 100 is a simple matter facilitated by the lift-out filter 16*a*. Fountain arrangement 100 is designed whereby it may be conveniently fitted to replace existing less efficient fountain arrangements.

As mentioned at the beginning hereof, the present fountain arrangement particularly relates to dampening rolls of a printing press. However, it will be understood there may be other applications to which the fountain arrangement may be applied, where it may similarly service rolls of a different type. Likewise the novel fountain cleaning means disclosed herein, may be applied to other type fountains.

I claim:

1. An elongated fountain pan for receiving an elongated press dampening roll therein, comprising in combination:

(a) dampening solution inlet means in said pan in the form of a plurality of spaced apart dampening solution apertures extending lengthwise of the pan and accordingly lengthwise of the dampening roll whereby the dampening solution may enter the pan generally uniformly throughout its length and thus maintain a generally even temperature of the dampening throughout the length of the pan;

(b) control means in said pan for use in controlling the level of dampening solution within said pan, said control means comprising an elongated dam-wall extending lengthwise of said pan in spaced generally parallel relation to said plurality of dampening solution apertures whereby said dampening solution entering into said pan via said dampening solution apertures may travel a relatively short distance within said pan before exiting therefrom over said dam-wall, affording ready and thus efficient removal of contaminants from the dampening solution in said pan, and assisting in keeping the dampening solution in said pan at a relatively low operating aperture; and (c) drain means in said pan remote from said inlet means, for use in removing said dampening solution following its passage over said dam-wall.

2. An elongated fountain pan as defined in claim 1, including a filter means for filtering the dampening solution following its passage over said dam-wall and prior to its exiting from said pan via said drain means.

3. An elongated fountain pan as defined in claim 2, wherein said filter means extends lengthwise of said pan and adjacent to said dam-wall.

4. An elongated fountain pan as defined in claim 3, wherein said filter means comprises a tray-like configuration which is removeably mounted within said pan.

5. An elongated fountain pan as defined in claim 1, wherein said dam-wall comprises an elongated upper portion over which said dampening solution flows, and means for adjustably moving said upper portion relative to said pan whereby the level of dampening solution in said pan may be adjusted to a selected level.

6. An elongated fountain pan as defined in claim 1, including control means adjacent an end thereof for use in controlling the amount of dampening solution entering into said pan.

7. An elongated fountain pan as defined in claim 1, wherein said pan comprises plastic material.

* * * * *